US007935159B2

(12) United States Patent
Hyun et al.

(10) Patent No.: US 7,935,159 B2
(45) Date of Patent: May 3, 2011

(54) DUST COLLECTING DEVICE FOR VACUUM CLEANER

(75) Inventors: Kie Tak Hyun, Changwon-si (KR); Young Bok Son, Changwon-si (KR); Kyeong Seon Jeong, Changwon-si (KR); Il Joong Kim, Gyeongsangnam-do (KR); Sung Hwa Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 306 days.

(21) Appl. No.: 11/990,503

(22) PCT Filed: Aug. 17, 2005

(86) PCT No.: PCT/KR2005/002684

§ 371 (c)(1),
(2), (4) Date: Mar. 30, 2009

(87) PCT Pub. No.: WO2007/021042

PCT Pub. Date: Feb. 22, 2007

(65) Prior Publication Data

US 2009/0199359 A1 Aug. 13, 2009

(51) Int. Cl.
*B01D 45/12* (2006.01)

(52) U.S. Cl. ..... 55/337; 55/343; 55/348; 55/349; 55/429; 55/459.1; 55/DIG. 3

(58) Field of Classification Search ..... 55/337, 55/343, 346, 348, 349, 429, 459.1, DIG. 3
See application file for complete search history.

(56) References Cited

U.S. PATENT DOCUMENTS

| | | | | |
|---|---|---|---|---|
| 7,534,279 | B2 * | 5/2009 | Oh et al. | 55/343 |
| 7,744,668 | B2 * | 6/2010 | Oh et al. | 55/343 |
| 2005/0172585 | A1 | 8/2005 | Oh et al. | |
| 2005/0172586 | A1 | 8/2005 | Oh et al. | |

FOREIGN PATENT DOCUMENTS

| | | |
|---|---|---|
| CN | 2592103 | 12/2003 |
| CN | 2631412 | 8/2004 |
| EP | 1 488 729 | 12/2004 |
| GB | 2 362 341 | 11/2001 |
| GB | 2 372 435 | 8/2002 |
| GB | 2 399 780 | 9/2004 |
| GB | 2 406 067 | 3/2005 |
| JP | 2002-326041 | 11/2002 |
| JP | 2004-135700 | 5/2004 |

* cited by examiner

*Primary Examiner* — Robert A Hopkins

(74) *Attorney, Agent, or Firm* — McKenna Long & Aldridge LLP

(57) ABSTRACT

Object of the present invention is to provide a dust collecting device (100) for a vacuum cleaner of which dust collecting performance is improved. For this, the dust collecting of the present invention includes two parallel primary cyclones (210, 220) for separating dust by a cyclone principle, and two secondary cyclones (250, 260) for separating dust introduced thereto from the primary cyclones (210, 220) by the cyclone principle, and a dust container (110) for storing dust separated by the primary cyclones (210, 220) and the secondary cyclones (250, 260), wherein the two primary cyclones (210, 220) surround the two secondary cyclones (250, 260), respectively.

20 Claims, 8 Drawing Sheets

[Fig. 1]
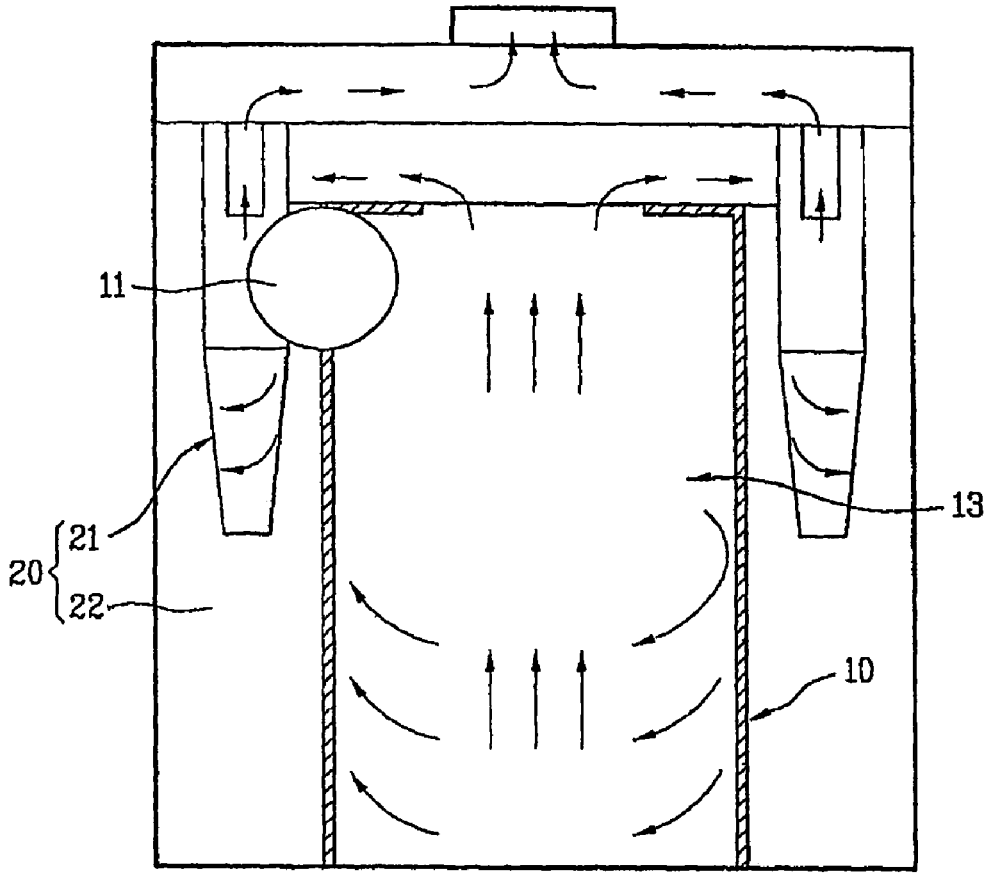

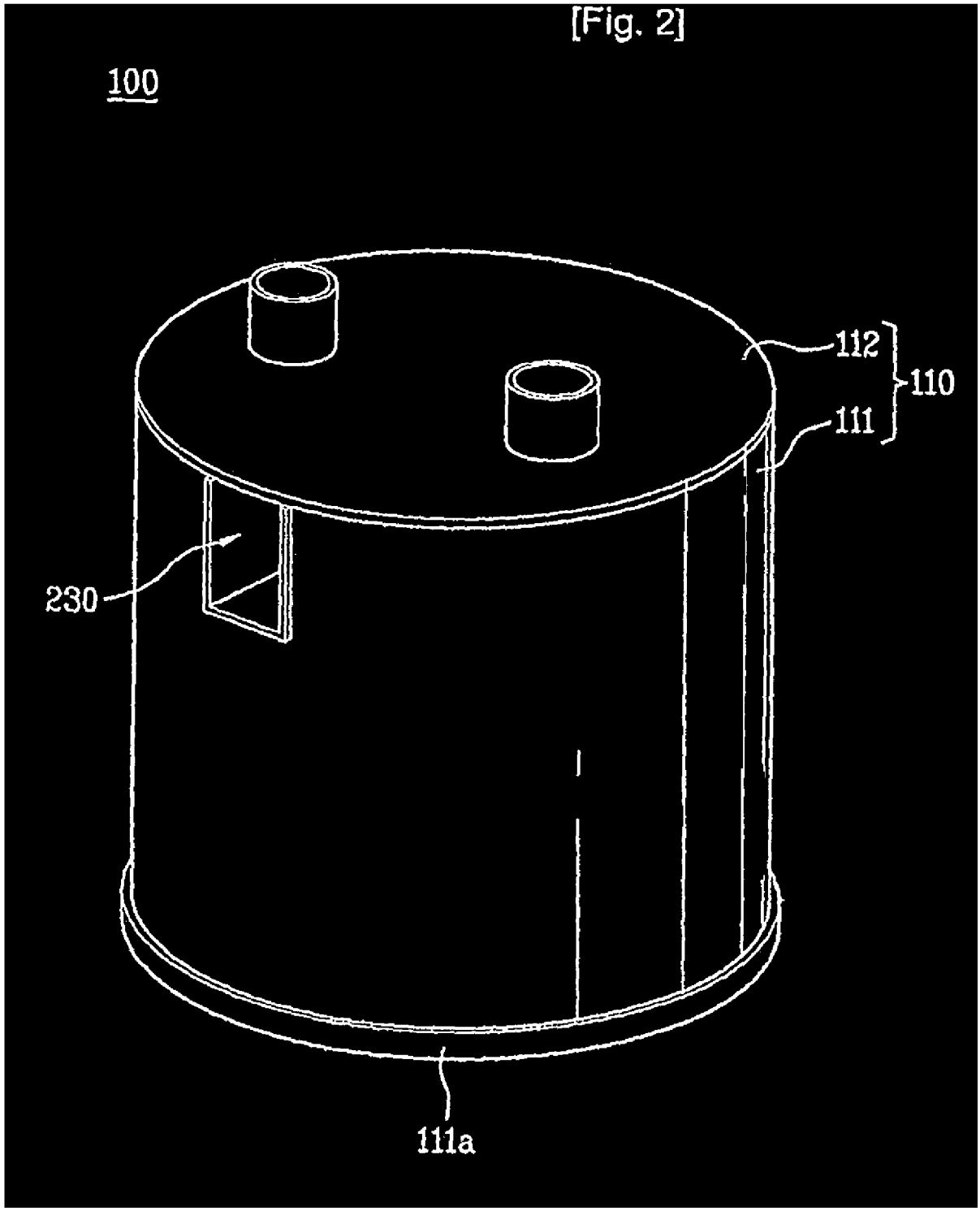
[Fig. 2]
100
112
110
111
230
111a

[Fig. 3]
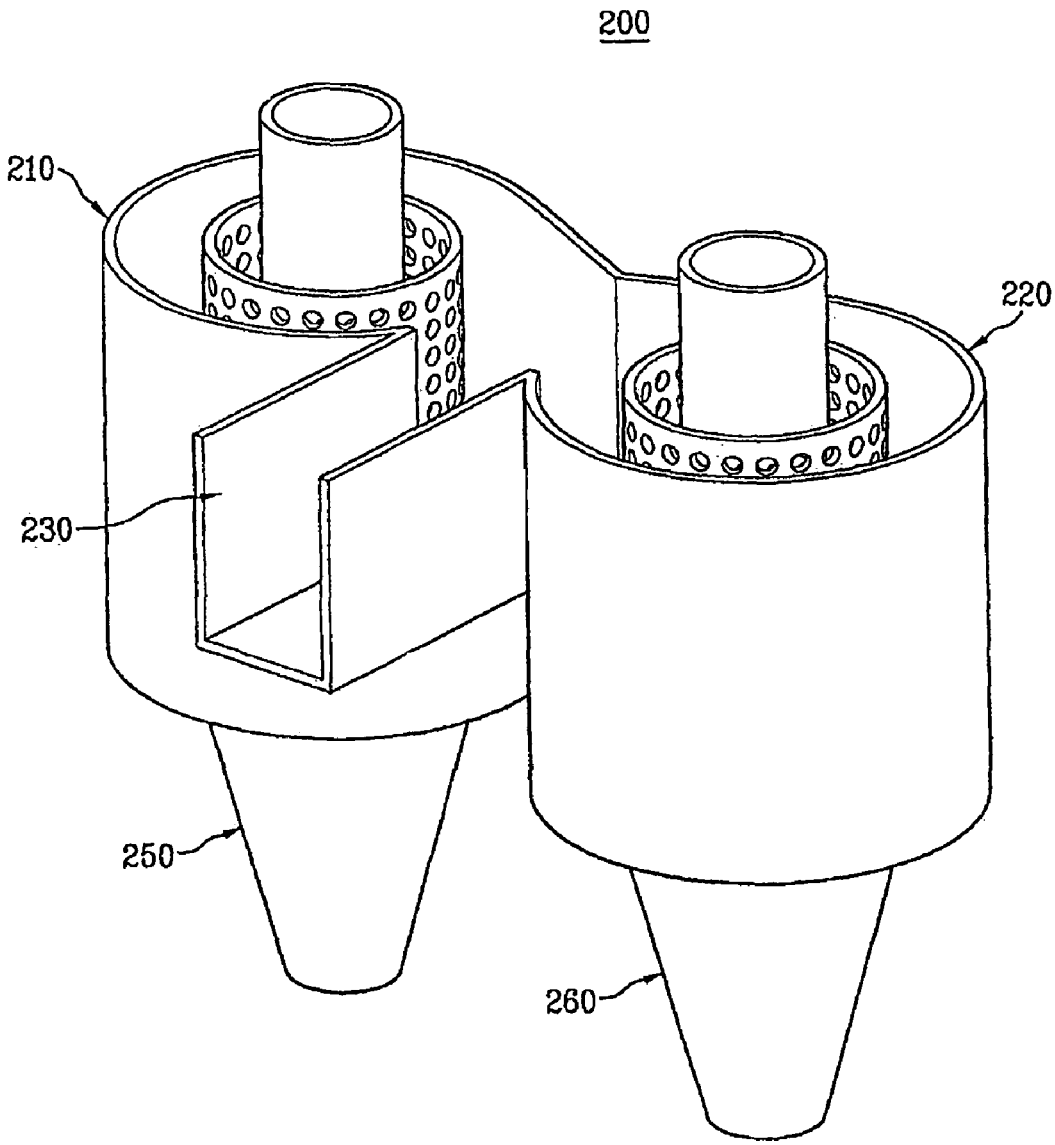

[Fig. 4]
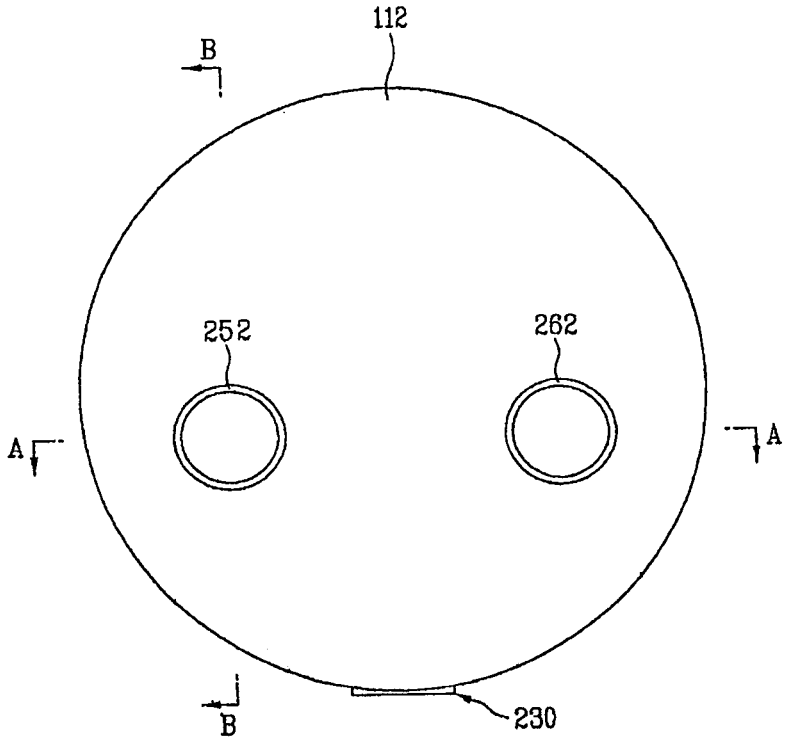
[Fig. 5]
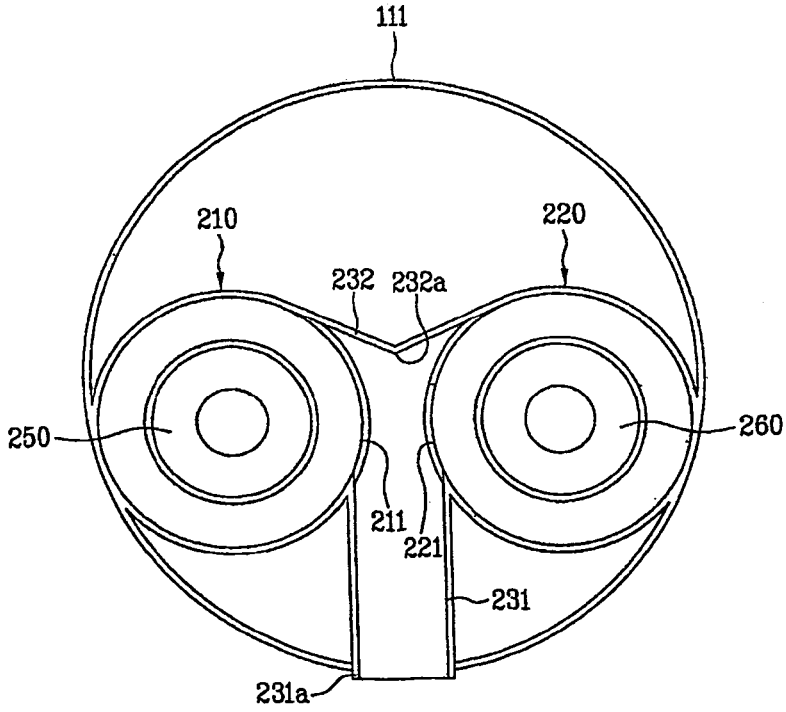

[Fig. 6]
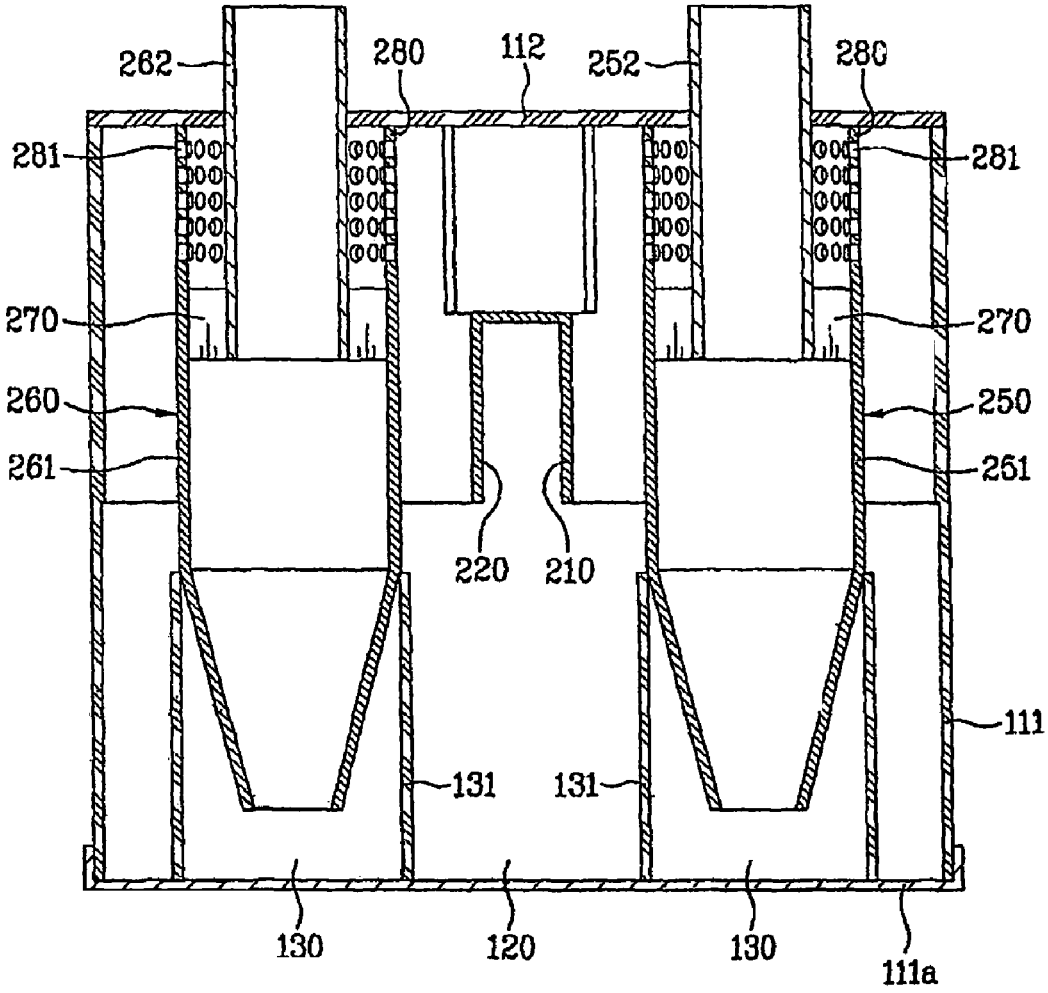

[Fig. 7]
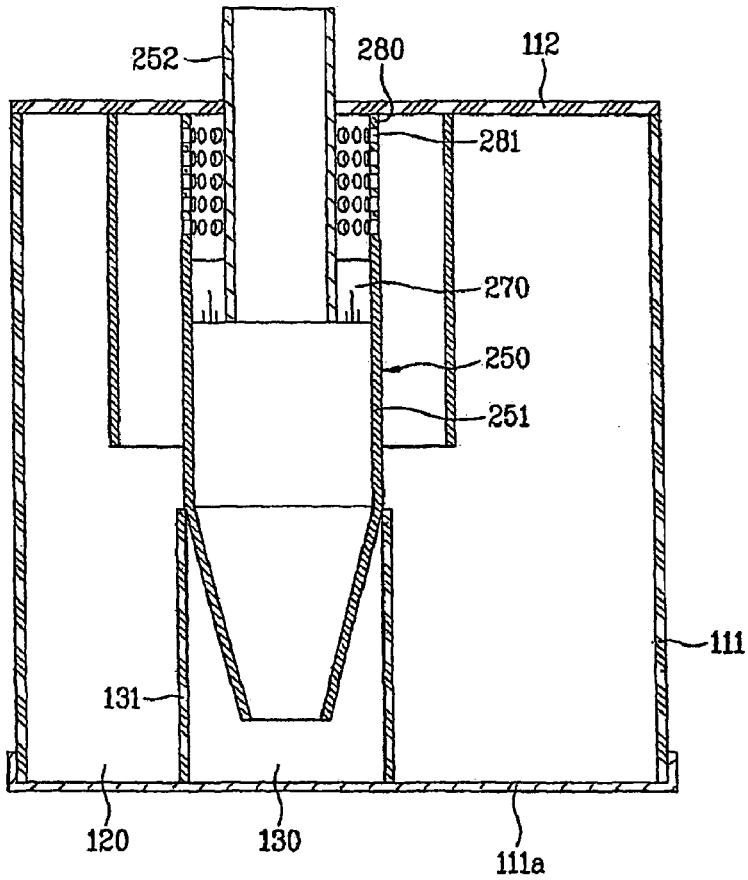
[Fig. 8]
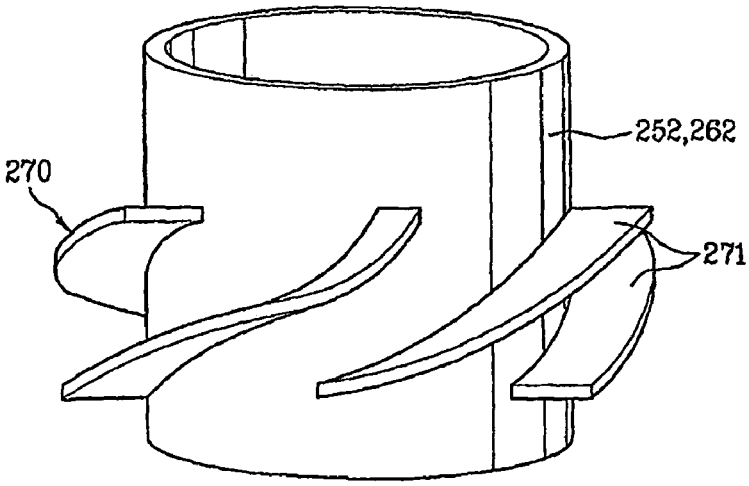

[Fig. 9]
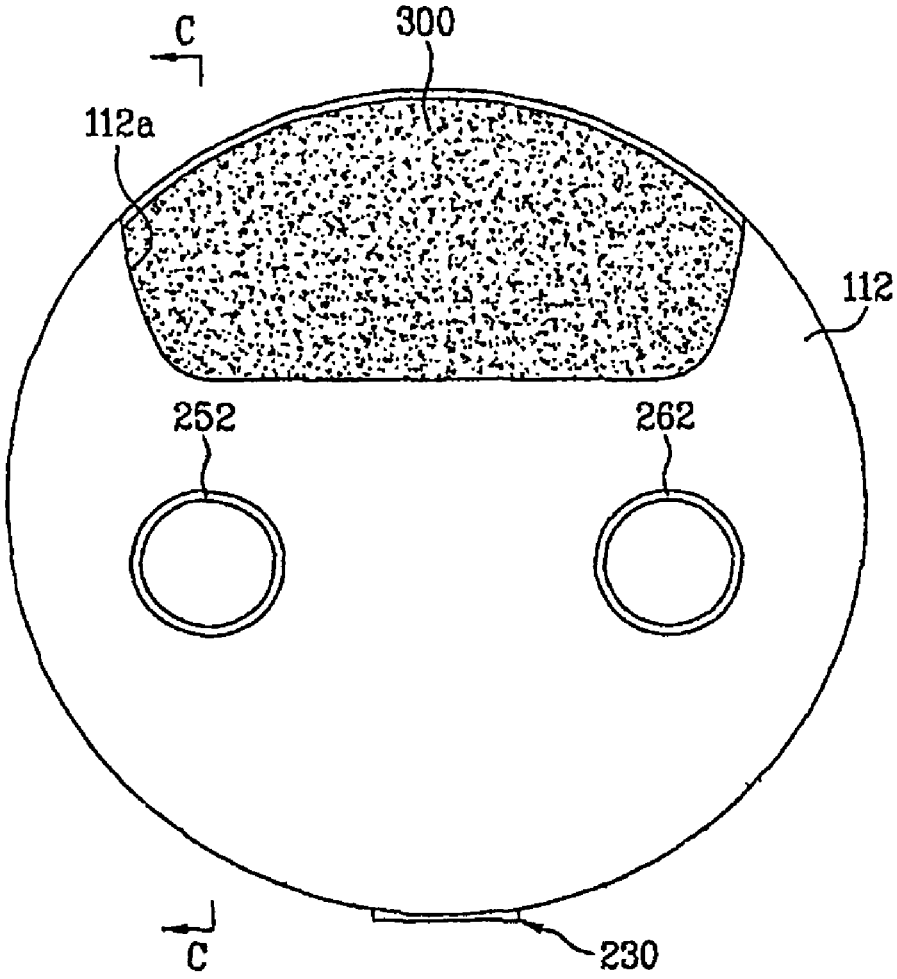

[Fig. 10]
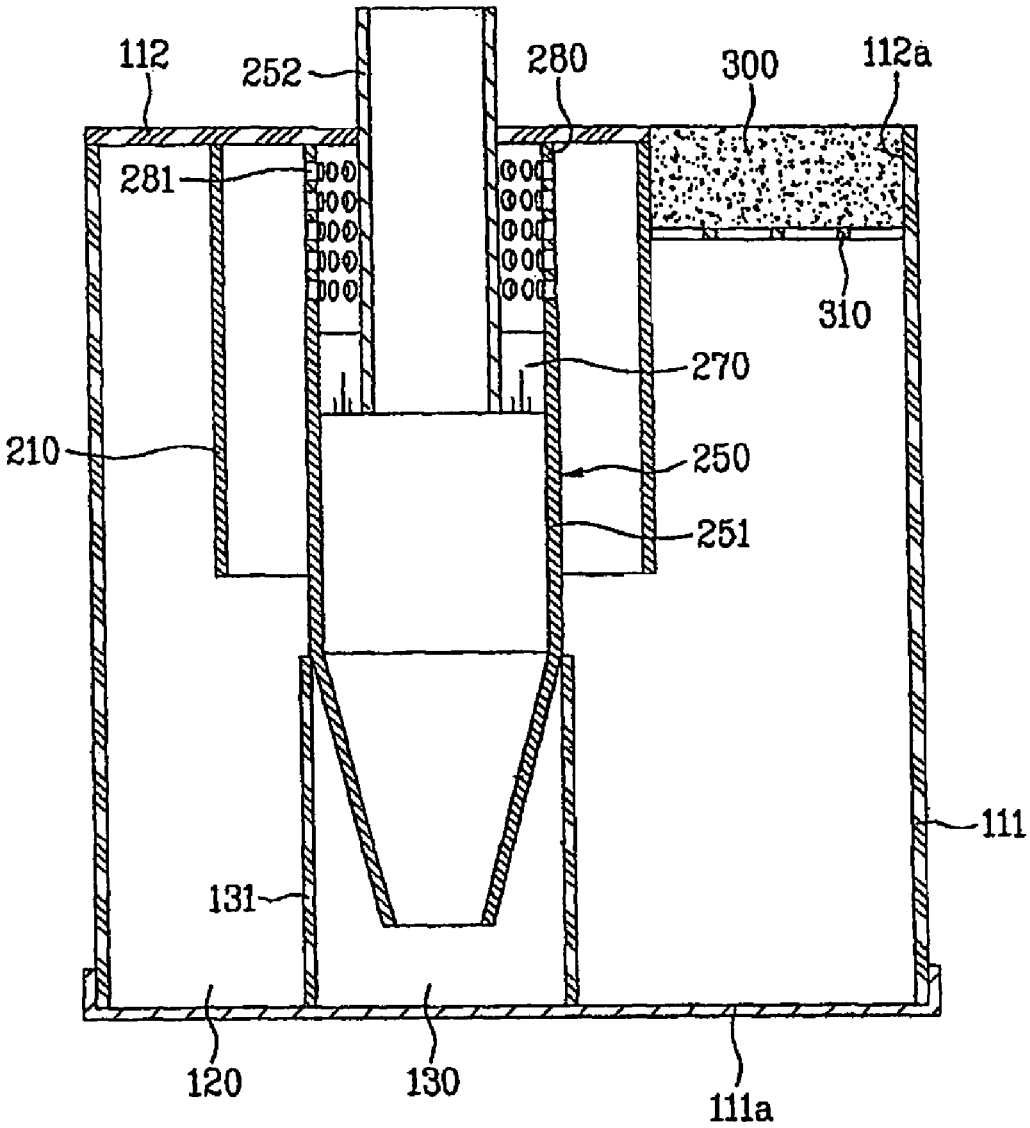

DUST COLLECTING DEVICE FOR VACUUM CLEANER

This application claims the benefit of PCT Patent Application No. PCT/KR2005/002684, filed Aug. 17, 2005, which is hereby incorporated by reference in its entirety.

TECHNICAL FIELD

The present invention relates to a dust collecting device for a vacuum cleaner, and more particularly, to a dust collecting device for a vacuum cleaner which collects dust by a cyclone principle.

BACKGROUND ART

In general, the cyclone dust collecting device is applied to a vacuum cleaner, for separating foreign matters, such as dust, from circulating air, to collect the dust.

The cyclone principle utilizes a difference of centrifugal forces for separating foreign matters, such as dust, from air circulating in a spiral.

Recently, the cyclone dust collecting device, collecting dust by using, the cyclone principle, is generally applied to the vacuum cleaner owing to advantages of the cyclone dust collecting device in that dust collecting performance is good and dust can be removed easily compared to a bag-type dust collecting device in which a dust bag is mounted in an air flow passage for collecting dust.

A related art dust collecting device for a vacuum cleaner will be described with, reference to FIG. 1.

The related art dust collecting device is provided with a primary cyclone dust colleting unit 10 for drawing contaminated air containing dust and collecting comparatively large sized particles of the dust therefrom, and a secondary cyclone dust collecting unit 20 on an outside of the primary cyclone dust colleting unit 10 for collecting comparatively small sized particles of the dust.

The primary cyclone dust collecting unit 10, a cylindrical container having a bottom in close contact with a bottom of the dust collecting device, has a suction pipe 11 in a side surface of an upper portion for introduction of contaminated air containing foreign matters in a tangential direction of an inside wall of the primary cyclone dust collecting unit, and a discharge opening 12 at a center of a top for discharging air cleaned primarily.

According to this, the primary cyclone dust collecting unit 10 has an upper space forming a primary cyclone 13 for separating foreign matters by centrifugal force, and a lower space forming a primary dust storage portion 14 for storing foreign matters separated by the centrifugal force.

In the meantime, the air from the discharge opening 12 is introduced to the secondary cyclone dust collecting unit 20, and discharged upward after passed through a dust separating step, again.

In more detail, the secondary cyclone dust collecting unit 20 includes a plurality of small sized secondary cyclones 21 arranged in a circumferential direction around the upper portion of the primary cyclone dust collecting unit 10, and a secondary dust storage portion 22 for storing dust separated at the secondary cyclone dust collecting unit 21.

The secondary dust storage portion 22 is under the secondary cyclones 21 around the primary dust storage portion. The primary dust storage portion 14 and the secondary dust storage portion 22 are separated by an outside wall of the primary cyclone dust collecting unit 10.

However, the related art dust collecting device has a problem in that a dust collecting performance of the primary cyclone dust collecting unit that collects a major portion of the dust is poor because the foreign matters, such as dust, is separated and collected only with single primary cyclone unit.

Moreover, since the suction pipe is asymmetric, which is extended from one side of the related art dust collecting device toward a center portion thereof, the related art dust collecting device has problems in that the suction pipe is long, air tightness between the cleaner body and the dust collecting device is poor, and a air flow resistance is high due to the bent air flow passage.

Because the primary cyclone and the primary dust storage portion are formed as one unit in the cylindrical primary cyclone dust collecting unit having the same upper and lower inside diameters, the dust flies up from the primary dust storage portion toward an upper side of the primary cyclone by the spiral circulation of air in the primary cyclone, thereby leading the dust collecting performance poor.

Furthermore, in the related art dust collecting device, because the secondary dust storage portion is around the primary dust storage portion, if a capacity of the primary dust storage portion is made greater, a width of the secondary dust storage portion becomes smaller, causing difficulty both in removal of foreign matters from a wall of he secondary dust storage portion, and checking an amount of dust accumulated in the primary dust storage portion due to the secondary dust storage portion that shades the primary dust storage portion.

DISCLOSURE OF INVENTION

Technical Problem

An object of the present invention is to provide a dust collecting device for a vacuum cleaner, which has an improved dust collecting performance.

Technical Solution

The object of the present invention can be achieved by providing a dust collecting device for a vacuum cleaner including two parallel primary cyclones for separating dust by a cyclone principle, and two secondary cyclones for separating dust introduced thereto from the primary cyclones by the cyclone principle, and a dust container for storing dust separated by the primary cyclones and the secondary cyclones, wherein the two primary cyclones surround the two secondary cyclones, respectively.

Preferably, the dust container is symmetric exterior in a left/right direction

The primary cyclones are connected to a suction air guide portion for guiding the air containing dust to the primary cyclones.

Preferably, the suction air guide portion is symmetric with respect to a plane of symmetry of the dust container.

The primary cyclones are in the dust container, and symmetric to each other with respect to the plane of symmetry of the dust container.

Preferably, the primary cyclones are provided in the dust container in an up/down direction.

The suction air guide portion includes a suction pipe having an inlet portion at an upper portion of an outside circumferential surface of the dust container, and a guide wall for guiding the air guided by the suction pipe to insides of the primary cyclones.

The primary cyclones have first inlets between the guide wall and the suction pipe, respectively.

The guide wall is opposite to the suction pipe, and has one end and the other end connected to one side edge of one of the first inlets, and one side edge of the other one of the first inlets respectively, and a middle portion projected toward the suction pipe for splitting the air supplied through the suction pipe in two sides toward the first inlets.

The primary cyclones have top ends connected to an upper cover openably provided to an upper portion of the dust container.

The primary cyclones are spaced predetermined heights from a bottom of the dust container.

The dust collecting device further includes a filter in the dust container for filtering dust from the air from the dust container.

The filter is on one side of the primary cyclones, such that a portion of the air introduced to the primary cyclones is discharged to an outside of the dust container through the secondary cyclones, and rest of the air is discharged to the outside of the dust container through the filter.

The dust container forms a bottom of the primary dust collecting chamber for storing dust separated by the primary cyclones, and a bottom of the secondary dust collecting chamber for storing dust separated by the secondary cyclones, and includes an openable bottom.

The secondary cyclones includes secondary cyclone bodies mounted in the secondary cyclones in an up/down direction respectively, and a spiral circulation forming member in each of the secondary cyclone bodies.

The spiral circulation forming member includes at least one blade provided to an upper portion of the secondary cyclone body.

The at least one blade is provided to an outside circumferential surface of an air discharge pipe inserted in the upper portion of the secondary cyclone body for guiding air discharged from the secondary cyclone body.

The air discharge member has a lower end connected to a top of the secondary cyclone body and a top connected to the top of the dust container.

The dust container includes secondary dust containers between lower portions of the secondary cyclone bodies and the bottom of the dust container surrounded by an inside circumferential surface of the dust container, for storing dust separated by the secondary cyclone body.

Advantageous Effects

The two primary cyclones parallel with each other and the two secondary cyclones surrounded by the primary cyclones respectively permits to improve a dust collecting performance and minimize an air flowing distance.

BRIEF DESCRIPTION OD THE DRAWINGS

The accompanying drawings, which are included to provide a further understanding of the invention, illustrate embodiment(s) of the invention and together with the description serve to explain the principle of the invention. In the drawings;

FIG. 1 illustrates a section of a related art cyclone dust collecting device;

FIG. 2 illustrates a perspective view of a dust collecting device in accordance with a preferred embodiment of the present invention;

FIG. 3 illustrates a perspective view of a cyclone unit in the dust collecting device in FIG. 2;

FIG. 4 illustrates a plan view of the dust collecting device in FIG. 2;

FIG. 5 illustrates a plan view showing a state the cyclone unit in the dust collecting device is mounted to a dust container body;

FIG. 6 illustrates a longitudinal section across a line A-A in FIG. 3;

FIG. 7 illustrates a longitudinal section across a line B-B in FIG. 3;

FIG. 8 illustrates a perspective view showing an embodiment of a spiral circulation forming member in the dust collecting device, of the present invention;

FIG. 9 illustrates a plan view of a dust collecting device in accordance with another preferred embodiment of the present invention; and FIG. 10 illustrates a longitudinal section across a line C-C in FIG. 9.

BEST MODE FOR CARRYING OUT THE INVENTION

Reference will now be made in detail to the preferred embodiments of the present invention, examples of which are illustrated in the accompanying drawings. Wherever possible, the same names and reference numbers will be used throughout the drawings to refer to the same or like parts, and repetitive description of which will be omitted.

As one embodiment of a vacuum cleaner having a dust collecting device in accordance with a preferred embodiment of the present invention applied thereto, a canister type vacuum cleaner will be described.

The vacuum cleaner includes a suction nozzle for drawing air containing foreign matters while moving along a floor to be cleaned a cleaner body provided separate from the suction nozzle, and a connection pipe connected between the suction nozzle and the cleaner body for guiding contaminated air from the suction nozzle to the cleaner body.

The suction nozzle has a predetermined size of nozzle suction opening in a bottom for drawing dust from the floor by air suction force generated at the cleaner body.

Mounted inside of the cleaner body, there are an electric unit for controlling the vacuum cleaner, and a motor-fan assembly for drawing air.

In more detail, the cleaner body has a hose connection portion at a front upper center for connecting the connection pipe thereto, wheels rotatably mounted at opposite sides of a rear of the cleaner body for smooth moving of the cleaner body on the floor, and a caster at a front portion of a bottom of the cleaner body, for changing a direction of the cleaner body.

In the meantime, the cleaner body has the dust collecting device in accordance with a preferred embodiment of the present invention detachably mounted thereto for separating and collecting foreign matters, such as dust.

Air from the dust collecting device passes a predetermined air discharge passage in the cleaner body, and the motor-fan assembly, and is discharged to an outside of the cleaner body.

The dust collecting device may be mounted to a rear portion of the cleaner body or a front portion of the cleaner body.

For this, the cleaner body has a dust collecting device mounting portion at the rear or front portion of the cleaner body for mounting the dust collecting device.

Between the hose connection portion and the dust collecting device mounting portion, there is a suction flow passage passed through an upper portion of the cleaner body in a front/rear direction for guiding the air containing dust to the dust collecting device.

The dust collecting device 100 in accordance with a preferred embodiment of the present invention will be described with reference to a case the dust collecting device is mounted to the rear portion of the cleaner body.

Referring to FIGS. 2 and 4, the dust collecting device 100 in accordance with a preferred embodiment of the present invention includes a dust container 110 for storing dust, and a cyclone unit 200 in the dust container for separating dust by the cyclone principle.

The cyclone unit 200 includes primary cyclones, and secondary cyclones, both for separating dust by the cyclone principle.

In the dust collecting device of the present invention, the cyclone unit includes two primary cyclones 210, and 220, and two secondary cyclones 250, and 260 arranged in parallel, wherein the two secondary cyclones 250, and 260 are surrounded by the two primary cyclones, respectively.

The dust container 110 surrounds the primary cyclones 210, and 220 for storing dust separated by the primary cyclones and the secondary cyclones.

For this, inside of the dust container 110, there are dust collecting spaces for storing dust separated by the primary cyclones 210, and 220, and the secondary cyclones 250, and 260.

It is preferable that the dust container 110 has a symmetric exterior in a left/right direction.

In more detail, with respect to a predetermined plane of symmetry, the exterior of the dust container 110, i.e., a portion on one side of the plane of symmetry and a portion oh the other side of the plane of symmetry form symmetry. The plane of symmetry of the dust container 110 is an imaginary plane which is perpendicular to a bottom of the dust container, and divides the exterior of the dust container 110, equally.

The dust container 110 forms an exterior of the dust collecting device in accordance with a preferred embodiment of the present invention, and it is preferable that a top thereof can be opened.

For this, the dust container 110 may include a dust container body 111 having an opened top, and an upper cover 112 for opening/closing the top of the dust container body 111.

Accordingly, the upper cover 112 is openably provided to a top of the dust container 110.

Moreover, it is preferable that the upper cover 112 is provided with a air discharge cover (not shown), for collecting the air discharged from the cyclone unit having the dust separated therefrom, and discharging to the discharge flow passage in the cleaner body.

Referring to FIGS. 5 to 7, in the dust collecting device in accordance with a preferred embodiment of the present invention, as described before, the secondary cyclones are provided in the primary cyclones respectively, for separating dust from the primary cyclones 250, and 260 respectively by the cyclone principle.

The two primary cyclones 210, and 220 are connected to a suction air guide portion 230 for guiding the air containing dust to the primary cyclones 210, and 220.

The suction air guide portion 230 guides the air containing dust from an outside of the dust container 110, more specifically, from a suction flow passage of the cleaner body to an inside of the primary cyclones 210, and 220.

For this, the suction air guide portion 230 is connected to the suction flow passage which passes a front portion of the cleaner body, specifically, an upper center of the cleaner body, in a front/rear direction.

It is preferable that the suction air guide portion 230 is symmetry with respect to the plane of symmetry of the dust container 110.

According to this, the plane of symmetry of the dust container 110 contains an axis of the suction air guide portion 230. Moreover, inside of the dust container 110 symmetric in a left/right direction, the two primary cyclones 210, and 220 are arranged in symmetry with respect to the plane of symmetry of the dust container 110.

In the embodiment, each of the primary cyclones 210, and 220 is cylindrical provided in the dust container 110 in an up/down direction:

In more detail, each of the primary cyclones 210, and 220 is provided in the dust container body 111 such that an axis direction thereof is vertical. Moreover, the primary cyclones are provided at positions spaced a distance from each other.

The suction air guide portion 230 includes a suction pipe 231 connected to the suction flow passage, and a guide wall 232 for guiding the air guided by the suction pipe 231 to insides of the primary cyclones 210, and 220.

In this instance, the suction pipe 231 has an inlet 231*a* at an upper outside circumference of the dust container 110, wherein the inlet 231*a* is at upper center of the exterior of the dust container body 111 when the dust container 110 is seen along the axis of the suction pipe 231.

Each of the primary cyclones 210, and 220 has a first inlet 211, or 221 at an upper outside circumference between the guide wall 232 and the suction pipe 231, such that the air guided by the guide wall 232 is introduced to the primary cyclones through the first inlets 211, and 221 of the primary cyclones 210, and 220.

In a case the inlet 231*a* of the suction pipe is provided to an upper front of the dust container body 111 like the embodiment, the axis of the suction pipe 231 passes through the exterior of the dust container body 111 in a front/rear direction.

The suction pipe 231 is extended toward the guide wall 232, such that the guide wall 232 is opposite to the suction pipe 231.

Moreover, the guide wall 232 has one end, and the other end connected to one side edge of one of the first inlets 211, and 221, and one side edge of the other one of the first inlets 211, and 221 respectively, and a middle portion projected toward the suction pipe 231 for splitting the air supplied through the suction pipe 231 in two sides toward the first inlets 211, and 221.

In a case the exterior of the dust container 110 is divided into a left side portion and a right side portion by the plane of symmetry in a front/rear direction, on the left/right sides of the plane of symmetry, the primary cyclones 210, and 220 are provided respectively, and the inlets are provided to one side and the other side of the guide wall 232, respectively.

For convenience of description, of the primary cyclones 210, and 220, if the primary cyclone 210 on a left side of the plane of symmetry will be called as a left side cyclone, and the primary cyclone 220 on a right side of the plane of symmetry will be called as a right side cyclone, the first inlets 211, and 221 are formed on a right side outside circumferential surface of the left side cyclone 210 and on a left side outside circumferential surface of the right side cyclone 220; respectively.

According to this, a left end of the guide wall 232 is connected to a rear edge of the first inlet 211 in the outside circumferential surface of the left side cyclone 210, and a right end of the guide wall 232 is connected to a rear edge of the first inlet 221 in the outside circumferential surface of the right side cyclone 220.

The guide wall has a middle portion 232*a* of a shape projected forward toward the suction pipe 231, i.e., a shape diverged as it goes toward a rear side the more.

The dust container 110 includes a primary dust collecting chamber 120 which forms a primary dust collecting space for storing dust separated by the primary cyclones 210 and 220, and at least one secondary dust collecting chamber 130 which forms a secondary dust collecting space for storing dust separated by the secondary cyclones 250, and 260.

Moreover, the dust container 110 has a bottom which forms bottoms of the primary dust collecting chamber 120 and the secondary dust collecting chamber 130, and it is preferable that the bottom of the dust container 110, i.e., the bottom of the dust container body 111 can be opened for easy discharge of dust.

In the embodiment, the dust container 110 has an outside wall which forms an outside wall of the primary dust collecting chamber 120, and on an inside of the primary dust collecting chamber 120, the primary cyclones 210, and 220 are provided side by side.

In other words, an inside circumferential surface of the dust container 110 forms an inside circumferential surface of the primary dust collecting chamber 120, and the inside circumferential surface of the primary dust collecting chamber 120 surrounds outside circumferential surfaces of the primary cyclones 210, and 220.

In more detail, the outside circumferential surfaces of the primary cyclones 210, and 220 are surrounded by the primary dust collecting chamber 120 in a state in contact to or not in contact to the inside circumferential surface of the primary dust collecting chamber 120. The word of "contact" is a concept including that the primary cyclones are formed as one body with the inside circumferential surface of the primary dust collecting chamber 120.

In the embodiment, a portion of the outside wall of each of the primary cyclones 210, and 220 is formed as one body with, and fixed to, the inside wall of the dust container body 111.

Of course, the primary cyclones 210, and 220 may be connected to the upper cover 112. In this instance, the primary cyclones 210, and 220 may be detachably connected to the upper cover 112, or may be formed as one body with the upper cover 112.

According to this, when the user opens the upper cover 112, the primary cyclones 210, and 220 are separated from the dust container body 111 together with the upper cover 112, thereby enabling easy cleaning of the primary cyclone unit 200.

The primary cyclones 210, and 220 have bottoms spaced predetermined heights away from the bottom of the dust container 110 which forms the primary dust collecting chamber 120 respectively, and the bottoms of the primary cyclones 210, and 220 are opened fully, or have dust discharge holes (not shown) along bottom circumferences, for discharging dust to the primary dust collecting chamber 120.

According to this, foreign matters, such as dust, separated at the primary, cyclones 210, and 220 by the cyclone principle passes through the bottoms of the primary cyclones 210, and 220, and is stored in a lower space of the dust container 110.

In the dust collecting device of the present invention, because the primary dust chamber 120 surrounds the primary cyclones 210, and 220, the primary dust collecting chamber 120 has a cross sectional area greater than cross sectional areas of the primary cyclones 210, and 220.

Owing to above configuration, the dust circulating in a spiral, and separated by centrifugal force in the primary cyclones 210, and 220 passes the bottoms of the primary cyclones 210, and 220, and spreads along an inside wall of the primary dust collecting chamber 120 by the centrifugal force.

According to this, an amount of the dust laden on the air discharged from the primary cyclones 210, and 220 to the secondary cyclones 250, and 260 is minimized, to improve a dust separating performance of the primary cyclones 210, and 220, and a dust storage capacity of the primary dust collecting chamber 120.

Though not shown, it is preferable that the dust container 110 includes a partition wall provided under the suction air guide portion 230, for preventing dust separated by the left side cyclone 210 and the right side cyclone 220 from mixing with each other, forming turbulences in lower portions of the left side cyclone 210 and the right side cyclone 220.

In the meantime, the secondary cyclones 250, and 260 include secondary cyclone bodies 251, and 261 provided inside of the primary cyclones 210, and 220 in up/down directions for cleaning the air from the primary cyclones again, respectively.

Each of the secondary cyclone bodies 251, and 261 has a cylindrical shape, or a cone shape substantially with a sectional area perpendicular to an axis thereof which becomes the smaller as it goes toward a lower side.

Of course, each of the secondary cyclone bodies 251, and 261 may have a shape which is a combination of the two shapes.

For an example, alike the embedment, each of the secondary cyclone bodies 251, and 261 may substantially include a cylindrical upper body, and a lower body having a cross sectional area perpendicular to an axis thereof which becomes the smaller as it goes to a lower side. The lower body has an opened bottom for serving as a dust discharge opening.

It is preferable that the secondary cyclones 250, and 260 are formed as one body with the upper cover 112, for mounting/dismounting on the dust container body 111 together with the upper coyer 112.

Each of the secondary cyclones includes a spiral circulation forming member 270 provided inside of the secondary cyclone body 251, or 261 for forming a spiral circulation in the secondary cyclone body 251, or 261.

The spiral circulation forming member 270 includes at least one blade 271 provided in the secondary cyclone body.

In more detail, referring to FIGS. 7 and 8, the at least one blade 271 is provided to an outside circumferential surface of each of the air discharge pipe 252, and 262 inserted in an upper portion of the secondary cyclones 250, and 260.

The air discharge pipes 252, and 262 serve to discharge the air passed through the dust separating step at the secondary cyclones 250, and 260 to an upper side of the upper cover 112, and it is preferable that the air discharge pipes 252, and 262 are cylindrical.

In this instance, the air discharge pipes 252, and 262 have axes the same with the secondary cyclone bodies 251, and 261, and pass the upper cover 112 in an up/down direction, respectively. For this, the upper cover 112 has openings (not shown) passed through the upper cover 112 in an up/down direction in correspondence to the air discharge pipes 252, and 262.

It is preferable that the at least one blade 271 has an inside surface formed as one body with an outside circumferential surface of the air discharge pipe 252, or 262, and an outside surface formed as one body with an inside circumferential surface of the secondary cyclone body 251, or 261.

In the embedment, a plurality of helical blades 271 are provided to the outside circumferential surface of the air discharge pipe 252, or 262 at regular intervals in a circumferential direction of the air discharge pipe.

According to this, the air introduced to the secondary cyclone bodies 251, and 261 passes through a dust separating step while circulating in a spiral in the secondary cyclone bodies 251, and 261 by the blades 271, and discharged to an upper side of the upper cover 112 through the air discharge pipes 252, and 262.

In addition to this, it is preferable that each of the primary cyclones 210, and 280 has a hollow air discharge member 280 therein.

In more detail, the air passed through the dust separating step at the primary cyclones flows toward the secondary cyclone bodies 251, and 261 through the air discharge member 280.

For this, the air discharge member 280 has pass through holes 281 in an outside circumferential, surface for pass through of the air, and prevents foreign matters larger than the pass through holes from introducing to the secondary cyclone bodies 251, and 261.

In the embodiment, the air discharge member 280 is provided between a top of the secondary cyclone body 251, or 261 and a bottom of the upper cover 112, and supported by the secondary cyclone body 251, or 261.

The air discharge member 280 may have a cylindrical shape having an inside diameter the same with the inside diameter of the secondary cyclone body 251, or 261, or a cone shape having an inside diameter of a bottom thereof the same with the secondary cyclone body 251, or 261.

It is preferable that the two secondary cyclones 250, and 260 are symmetry with respect to the plane of symmetry of the dust container 110.

In the meantime, in the dust container 110, there are secondary dust containers 131 for forming secondary dust collecting spaces in correspondence to the secondary cyclones, respectively. The secondary dust containers 131 are provided between the lower portions of the secondary cyclones 251, and 261, and the bottom of the dust container, and form an outside wall of the secondary dust collecting chamber 130.

Preferably, the secondary dust container 131 has a cylindrical shape substantially, with a bottom in close contact with the dust container 110, and a top formed as one body with an outside circumferential surface of the lower body of the secondary cyclone bodies 251, and 261.

According to this, when the bottom 111*a* of the dust container 110 is opened the dust drops down from the primary dust collecting chamber 120, and the secondary dust collecting chamber 130 by gravity.

However, the secondary dust container 131 may have the bottom formed as one body with the bottom of the dust container 110, and die top in close contact with an outside circumferential surface of the lower body of the secondary cyclone body 251, or 261.

In the embodiment, though a number of the secondary dust container 131 is the same with a number of the secondary cyclones, the number is not limited to this, but the number of the secondary dust container 131 may be one such that dust separated by the secondary cyclones is stored in the one secondary dust collecting chamber.

In the meantime, in order to enable to determine a dust amount held in the primary dust collecting chamber 120, it is preferable that the outside wall Of the dust container 110 is formed of a material which can be see-through. Of course, it is also preferable, that an outside wall of the secondary dust container 110 is formed of a material which can be see-through.

The operation of the vacuum cleaner having the dust collecting device 100 of the present invention applied thereto will be described.

Upon putting the vacuum cleaner into operation, external contaminated air, introduced to the suction flow passage in the cleaner body through the suction nozzle and the connection pipe, is introduced to the two primary cyclones 210, and 220 in the tangential direction guided by the suction pipe 231, and the guide wall 232.

According to this, comparatively heavy and large particles of the dust are separated by the cyclone principle, and held in the primary dust collecting chamber 120.

The air primarily cleaned as the comparatively large particles are separated therefrom is discharged to the secondary cyclones 250, and 260 through the air discharge members 212, and 222.

In this instance, the plurality of blades 271 form a spiral circulation of air inside of the secondary cyclone bodies 251, and 261, such that the air passed through a dust separation step in the secondary cyclone bodies 251, and 261 is discharged to an upper side of the upper cover 112 through the air discharge pipes 252, and 262, and therefrom to an outside of the cleaner body after passing through the predetermined air discharge flow passage in the cleaner body and the motor-fan assembly.

Comparatively light particles of the dust separated at the secondary cyclones 250, and 260 are held in the secondary dust collecting chamber 130.

A dust collecting device in accordance with another preferred embodiment of the present invention will be described with reference to FIGS. 9 and 10.

Referring to FIGS. 9 and 10, the dust collecting device in accordance with another preferred embodiment of the present invention includes the dust container 110 which surrounds the cyclone unit in the dust collecting device in the foregoing embodiment of the present invention, and a filter 300 in the dust container 110.

The filter 300 filters dust from the air from the dust container 110, and is provided on one side of the primary cyclones 210, and 220.

On one side of the dust container 110, more specifically, at the upper cover 112, there is an air discharge portion 112*a* for discharging air passed through the filter, At an inside of an upper portion of the dust container body 111, or the upper cover 112, there is a filter mounting portion 310 for mounting the filter.

As other structures of the another embodiment is identical to the dust collecting device in accordance with the foregoing embodiment of the present invention, repetitive description of which will be omitted and the same names and reference symbols will be applied to the identical parts.

In the embodiment, the air introduced to the primary cyclones 210, and 220 is discharged to an outside of the dust container 110 through two paths. That is, the dust collecting device of the embodiment has two air flow passages.

A portion of the air introduced to the primary cyclones 210, and 220 is discharged to an outside of the dust container 110 through the secondary cyclones 250, and 260 and the air discharge pipes 252, and 262, and rest of the air is discharged to the outside of the dust container 110 through the filter 300.

In more detail, the filter 300 is provided to a rear of the primary cyclones 210, and 220, so that a portion of the air introduced to the primary cyclones 210, and 220 is discharged to the outside of the dust container 110 directly after passing through the filter via the primary dust collecting chamber 120.

In the meantime, the dust collecting device of the present invention is applicable both to the canister type vacuum cleaner, and the upright type vacuum cleaner.

It will be apparent to those skilled in the art that various modifications and variations can be made in the present invention without departing from the spirit or scope of the inventions.

Thus, it is intended that the present invention covers the modifications and variations of this invention provided they come within the scope of the appended claims and their equivalents.

INDUSTRIAL APPLICABILITY

The dust collecting device of the present invention having the foregoing design has the following advantages.

First, the parallel arrangement of the two primary cyclones improves a dust collecting performance of the primary cyclone unit which separates a major portion of the dust, to improve a performance of the dust collecting device, on the whole.

Second the symmetric exterior of the dust container in a left/right direction, to provide the suction pipe for guiding air to the primary cyclone unit at an upper center of the dust container improves air tightness to the cleaner body, and enables to reduce an air flow resistance.

Third the sectional area of the dust storage portion formed larger than the cross sectional area of the primary cyclone unit permits to minimize an influence of the circulating air from the primary cyclone unit to a circulating air containing the dust, hereby improving a dust separating performance.

Fourth, the formation of the outside wall of the dust container of a material which can be see-through to enable easy determination of a dust amount in the primary dust collecting chamber which stores a major portion of the dust permits an appropriate selection of a time for emptying the dust container.

Fifth, the provision of the secondary cyclone in the primary cyclone permits to minimize an air flow distance, and an air flow loss, and to make an entire structure of the dust collecting device compact.

Sixth, the two air discharge paths from the dust container in the another preferred embodiment of the invention permits to reduce a load on the secondary cyclones, and an air resistance.

The invention claimed is:

1. A dust collecting device for a vacuum cleaner comprising:

two parallel primary cyclones for separating dust by a cyclone principle; and two secondary cyclones for separating dust introduced thereto from the primary cyclones by the cyclone principle; and a dust container for storing dust separated by the primary cyclones and the secondary cyclones, wherein the two primary cyclones surround the two secondary cyclones, respectively.

2. The dust collecting device as claimed in claim 1, wherein the dust container is symmetric exterior in a left/right direction.

3. The dust collecting device as claimed in claim 2, wherein the primary cyclones are connected to a suction air guide portion for guiding, the air containing dust to the primary cyclones.

4. The dust collecting device as claimed in claim 3, wherein the suction air guide portion is symmetric with respect to a plane of symmetry of the dust container.

5. The dust collecting device as claimed in claim 3, wherein the primary cyclones are in the dust container, and symmetric to each other with respect to the plane of symmetry of the dust container.

6. The dust collecting device as claimed in claim 5, wherein the primary cyclones are provided in die dust container in an up/down direction.

7. The dust collecting device as claimed in claim 6, wherein the suction air guide portion includes;

a suction pipe having an inlet portion at an upper portion of an outside circumferential surface of the dust container, and a guide wall for guiding the air guided by the suction pipe to insides of the primary cyclones.

8. The dust collecting device as claimed in claim 7, wherein the primary cyclones have first inlets between the guide wall and the suction pipe, respectively.

9. The dust collecting device as claimed in claim 8, wherein the guide wall is opposite to the suction pipe, and has one end, and the other end connected to one side edge of one of the first inlets, and one side edge of the other one of the first inlets respectively, and a middle portion projected toward the suction pipe for splitting the air supplied through the suction pipe in two sides toward the first inlets.

10. The dust collecting device as claimed in claim 6, wherein the primary cyclones have top ends connected to an upper cover openably provided to an upper portion of the dust container.

11. The dust collecting device as claimed in claim 6, wherein the primary cyclones are spaced predetermined heights from a bottom of the dust container.

12. The dust collecting device as claimed in claim 1, further comprising a filter in the dust container for filtering dust from the air from the dust container.

13. The dust collecting device as claimed in claim 12, wherein the filter is on one side of the primary cyclones, such that a portion of the air introduced to the primary cyclones is discharged to an outside of the dust container through the secondary cyclones, and rest of the air is discharged to the outside of the dust container through the filter.

14. The dust collecting device as claimed in claim 1, wherein the dust container forms a bottom of the primary dust collecting chamber for storing dust separated by the primary cyclones, and a bottom of the secondary dust collecting chamber for storing dust separated by the secondary cyclones, and includes an openable bottom.

15. The dust collecting device as claimed in claim 1, wherein the secondary cyclones includes;

secondary cyclone bodies mounted in the secondary cyclones in an up/down direction respectively; and a spiral circulation forming member in each of the secondary cyclone bodies.

16. The dust collecting device as claimed in claim 15, wherein the spiral circulation forming member includes at least one blade provided to an upper portion of the secondary cyclone body.

17. The dust collecting device as claimed in claim 16, wherein the at least one blade is provided to an outside circumferential surface of an air discharge pipe inserted in the upper portion of the secondary cyclone body for guiding air discharged from the secondary cyclone body.

18. The dust collecting device as claimed in claim 15, wherein the secondary cyclones include hollow air discharge members in the primary cyclones respectively, each having a plurality of pass through holes in an outside circumferential surface for pass of air flowing toward the secondary cyclone body.

19. The dust collecting device as claimed in claim 18, wherein the air discharge member is provided between the top of the secondary cyclone body and the top of the dust container.

20. The dust collecting device as claimed in claim 15, wherein the dust container includes secondary dust containers between lower portions of the secondary cyclone bodies and the bottom of the dust container surrounded by an inside circumferential surface of the dust container, for storing dust separated by the secondary cyclone body.

* * * * *